US007331404B2

(12) United States Patent
Pusateri

(10) Patent No.: US 7,331,404 B2
(45) Date of Patent: Feb. 19, 2008

(54) LUBRICATION SYSTEM FOR IMPACT WRENCHES

(75) Inventor: Daniel S. Pusateri, Grayslake, IL (US)

(73) Assignee: Snap-on Incorporated, Kenosha, WI (US)

( * ) Notice: Subject to any disclaimer, the term of this patent is extended or adjusted under 35 U.S.C. 154(b) by 91 days.

(21) Appl. No.: 10/529,820

(22) PCT Filed: Oct. 10, 2003

(86) PCT No.: PCT/US03/32350

§ 371 (c)(1),
(2), (4) Date: Sep. 30, 2005

(87) PCT Pub. No.: WO2004/033155

PCT Pub. Date: Apr. 22, 2004

(65) Prior Publication Data

US 2006/0144601 A1 Jul. 6, 2006

Related U.S. Application Data

(60) Provisional application No. 60/417,749, filed on Oct. 10, 2002.

(51) Int. Cl.
*B25B 21/02* (2006.01)

(52) U.S. Cl. ..... 173/93.5; 173/93

(58) Field of Classification Search ..... 173/93, 173/93.5, 93.6, 205
See application file for complete search history.

(56) References Cited

U.S. PATENT DOCUMENTS

| | | | | |
|---|---|---|---|---|
| 2,425,793 | A | | 8/1947 | Fosnot |
| 3,119,456 | A | | 1/1964 | Burnett |
| 3,321,043 | A | | 5/1967 | Vaughn |
| 3,608,673 | A | | 9/1971 | Cucciati |
| 3,661,216 | A | | 5/1972 | Yamanaka |
| 4,002,212 | A | * | 1/1977 | Schoeps ..... 173/93.5 |
| 4,106,571 | A | | 8/1978 | Stone |
| 4,175,408 | A | | 11/1979 | Kasai et al. |
| 4,184,552 | A | | 1/1980 | Anderson |
| 4,287,956 | A | * | 9/1981 | Maurer ..... 173/93.5 |
| 4,333,537 | A | | 6/1982 | Harris et al. |
| 4,403,679 | A | | 9/1983 | Snider |
| 4,735,595 | A | * | 4/1988 | Schoeps ..... 464/25 |
| 4,977,966 | A | * | 12/1990 | Farber et al. ..... 173/159 |
| 4,991,472 | A | | 2/1991 | Hollingsworth |
| 5,103,544 | A | | 4/1992 | Patterson et al. |

(Continued)

FOREIGN PATENT DOCUMENTS

DE 201 18 029 U 1/2002

(Continued)

OTHER PUBLICATIONS

International Search Report for International Application PCT/US2003/32350, date completed Mar. 8, 2004.

*Primary Examiner*—Scott A. Smith
(74) *Attorney, Agent, or Firm*—Barnes & Thornburg LLP

(57) ABSTRACT

A lubrication apparatus, system and method for a tool is disclosed. The tool includes a rotating impact assembly and the lubrication apparatus, system and method directs lubricant from a radially outward position to a radially inward position in the impact assembly.

26 Claims, 3 Drawing Sheets

U.S. PATENT DOCUMENTS 5,377,769 A * 1/1995 Hasuo et al. ..... 173/169
5,377,770 A 1/1995 Ritter
5,645,130 A * 7/1997 Schoeps ..... 173/93.5
5,836,403 A 11/1998 Putney et al.
5,906,244 A * 5/1999 Thompson et al. ..... 173/93.5
5,954,141 A * 9/1999 Li et al. ..... 173/93.5
6,109,366 A 8/2000 Jansson et al.
6,164,393 A 12/2000 Bakke
6,305,246 B1 10/2001 Horvath
6,390,034 B1 5/2002 Orzal et al.
6,491,111 B1 * 12/2002 Livingston et al. ..... 173/93.5
6,527,061 B2 * 3/2003 Liao ..... 173/93.5
6,684,964 B2 * 2/2004 Ha ..... 173/29
6,889,778 B2 * 5/2005 Colangelo et al. ..... 173/93.5
6,983,808 B1 * 1/2006 Chen ..... 173/93.5

FOREIGN PATENT DOCUMENTS

GB 722 611 A 1/1955

* cited by examiner

LUBRICATION SYSTEM FOR IMPACT WRENCHES

CROSS REFERENCE

This application claims the benefit of PCT application No. PCT/US/32350 filed on Oct. 10, 2003, which claimed the benefit of U.S. Provisional Application Ser. No. 60/417,749 filed on Oct. 10, 2002.

BACKGROUND

The present disclosure relates to a lubrication apparatus system and method of use for a tool, and more particularly to a lubrication system for an impact assembly in a tool, the impact assembly driving a fastener with periodic impacts.

Impact wrenches and tools are used to drive a fastener, for example a bolt, into an object with the assistance of periodic impacts originating from the tool. The periodic impacts, much like using a hammer to strike a wrench when removing a lug nut, provide additional forces that drive a fastener either into or out of an object.

In an impact tool, periodic impact forces may be generated by allowing a motor to have a disengaged, momentum-building phase and an engagement phase. During the disengaged, momentum-building phase, the motor spins free of the fastener and fastener driver, building momentum in a flywheel or similar component. When the impact tool enters the engagement phase, the flywheel or similar component strikes the fastener driver, thereby delivering the momentum of the flywheel to the fastener in a sudden pulse or impact.

Due to the moving and impacting components associated with an impact tool, it is important to have the impact tool adequately lubricated. Furthermore, because lubricants are constantly being urged radially outwardly due to the centripetal forces that result from the numerous rotating components in an impact tool, it is also important to redirect the lubricants toward the radially inward portions of the tool.

According to the disclosure, an impact tool illustratively includes an impact assembly having a frame that houses a pair of hammers. The frame and hammers are rotationally driven by a motor, and the hammers move between a first and a second position to alternately impact and disengage from the anvil, which in turn drives the fastener driver.

At least one of the hammers includes a lubrication hole or port which delivers lubricant from the radially outward portions of the tool to the radially inward portions. Additionally, the frame can include grooves that direct the lubricant toward the lubrication ports.

SUMMARY OF THE DRAWINGS

The detailed description particularly refers to the accompanying figures in which.

DETAILED DESCRIPTION

Figure 1:
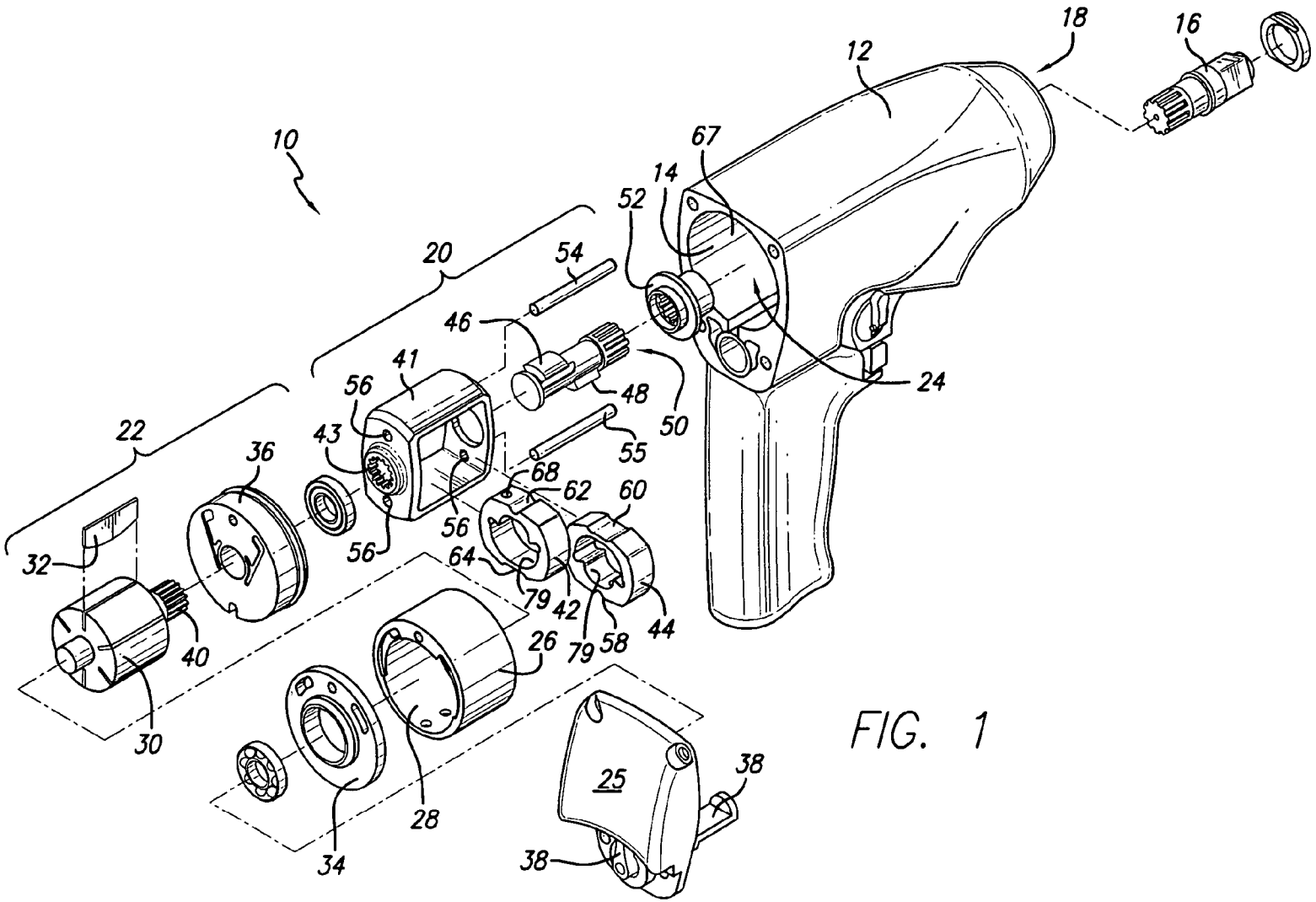
FIG. 1 is an exploded perspective assembly view of a pneumatically powered impact tool.
Figure 2:
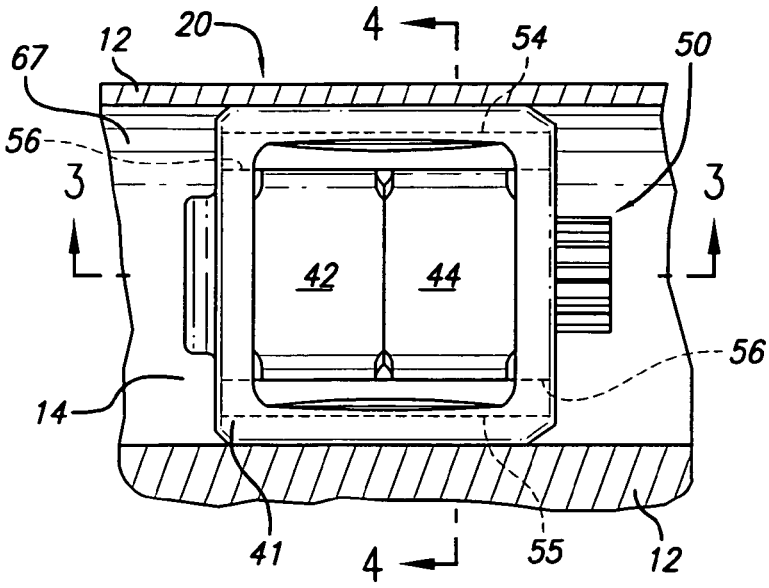
FIG. 2 is a partial fragmentary section view of an impact tool chamber of the assembled form of the tool in FIG. 1, showing the impact assembly inside the chamber.
Figure 3:
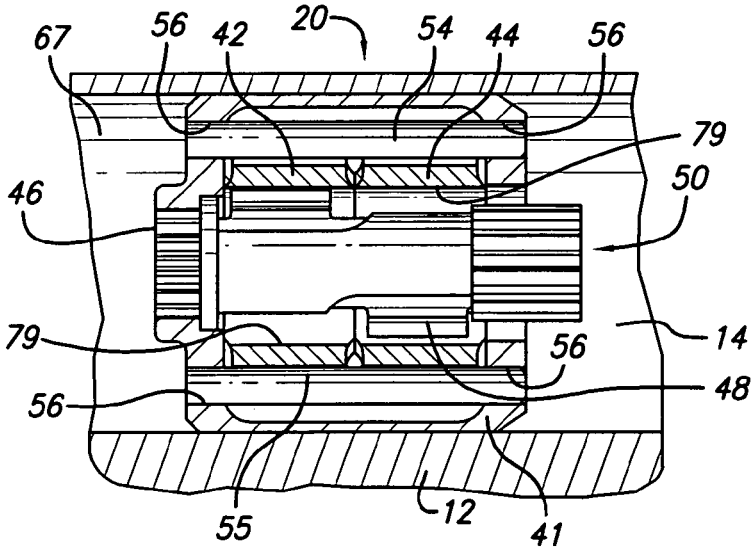
FIG. 3 is a partial fragmentary sectional view of the impact assembly of FIG. 2, taken along the line 3-3.

While the disclosure is susceptible to various modifications and alternative forms, specific exemplary embodiments thereof have been shown by way of example in the drawings and have herein been described in detail. It should be understood, however, that there is no intent to limit the disclosure to the particular forms disclosed, but on the contrary, the intention is to cover all modifications, equivalents, and alternatives falling within the spirit and scope of the disclosure as expressed by the following numbered features and elements.

An impact tool, illustratively a pneumatically powered impact wrench 10, is shown in FIG. 1. Impact tool 10 includes a housing 12 defining a generally cylindrical chamber 14 therein. A square drive or driver 16 is mounted for rotational movement at first end 18 of chamber 14. Driver 16 is illustratively interchangeable, and it should be understood that other tool configurations that mount for rotational movement or other impact tool functions are fully within the scope of the disclosure.

Impact assembly 20 and pneumatic motor assembly 22 are inserted from second end 24 of chamber 14, and rear cap 25 is fastened to second end 24 of chamber 14 to secure impact assembly 20 and motor assembly or drive assembly 22 within chamber 14. Illustratively, motor assembly 22 includes a casing 26 defining an off-center bore 28, a rotor 30 having extendable bushings 32, and a first end cap 34 and a second end cap 36. The drive assembly 22 is one form of means for providing momentum. Compressed air is directed by selector 38 through motor assembly 22 such that rotor 30 is moved in either a clockwise or counter-clockwise direction, depending on the path in which compressed air is directed by selector 38. It is within the scope of the disclosure, however, to utilize other types of motors or drive assemblies in order to create rotational movement. The rotational movement of rotor 30 is then transferred to impact assembly 20 via splined axle 40.

Impact assembly 20 includes a frame 41 which has a spline receptacle 43 for receiving the spline 40 for rotating the frame at the speed of rotor 30. The frame 41 houses a first hammer 42 and a second hammer 44. It should be understood that although two hammers 42, 44 are provided in the illustrative embodiment, it is within the scope of the disclosure to utilize one or any other number of hammers. The impact assembly is one form of means for providing hammering force retained in the housing.

An anvil 50 is retained in an operating bore 79 of the hammers 42,44. First and second hammers 42, 44 are configured to engage wings 46, 48, respectively, of anvil 50. The engagement of wings 46, 48 by hammers 42, 44 causes anvil 50 to rotate, and the rotational motion is transferred through connector 52 to square drive 16. Pins 54, 55 are positioned in frame 41 and held in place by apertures 56 formed in frame 41. Pins 54, 55 define the range of movement for first and second hammers 42, 44 by interacting with notches 58, 60, 62, 64 of hammers 42, 44 in the manner described below and illustrated in FIGS. 4-7.

Figure 4:
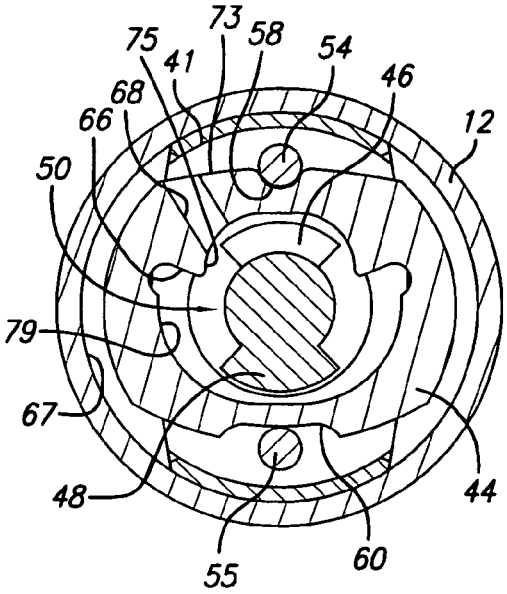
FIG. 4 is a sectional view of the impact assembly of FIG. 2, taken along the line 4-4 diagrammatically illustrating the impact tool chamber simplified as a cylindrical tube.
Figure 5:
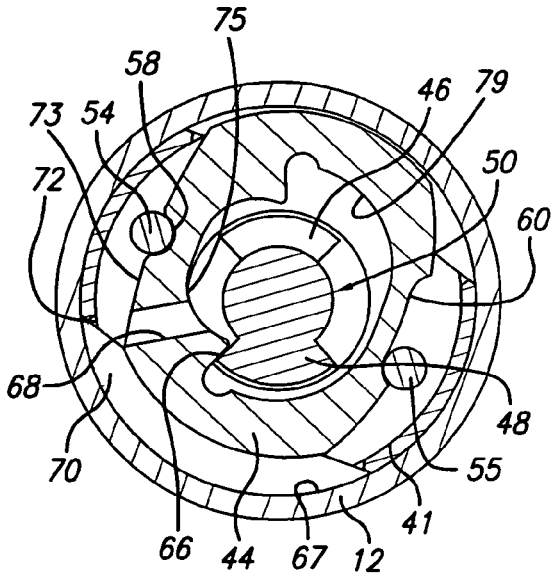
FIG. 5 is a view similar to that of FIG. 4, showing lubricant collecting along a wall of the chamber.
Figure 6:
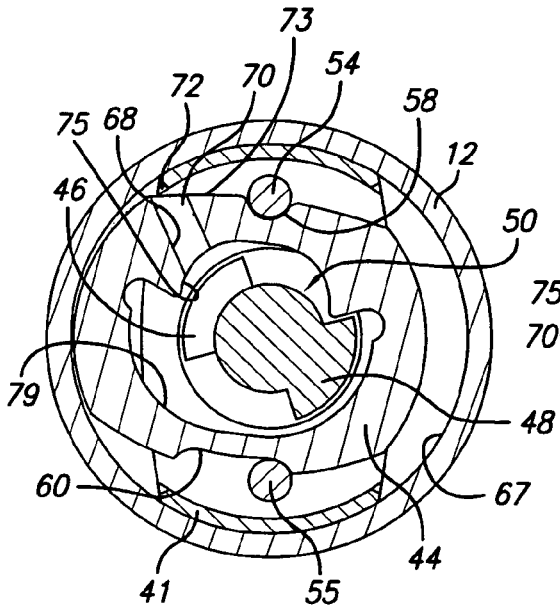
FIG. 6 is a view similar to that of FIG. 5, showing a port defined in the hammer for collecting the lubricant from the walls of the chamber.

Illustratively, notches 58 and 62 are sized and dimensioned to fit or receive pins 54, 55 such that lateral movement of hammers 42, 44 is generally prohibited. A degree of rotational movement of the hammers 42, 44 about pin 54, 55 axes is permitted. In contrast, notches 60, 64 are elongated and allow for sliding or shifting movement of hammers 42, 44 relative to pins 54, 55. Such movement corresponds with pivoting movement about the opposite notches 58, 62 and pin axes 54, 55. An intermediate position for hammer 44 is shown in FIG. 4, with pin 55 generally centered in notch 60 while FIG. 5 illustrates hammer 44 after being pivoted about top pin 54 in a counterclockwise direction. FIG. 6 shows hammer 44 after being pivoted about top pin 54 in a clockwise position.

In the illustrative embodiment, hammers 42, 44 are positioned in frame 41 and between pins 54, 55 such that hammer 42 pivots about top pin 54, and hammer 44 is reversed in orientation and pivots about bottom pin 55. In the illustrated drawings of FIGS. 4-7, portions of hammer 42 would normally be visible behind hammer 44, but have been omitted from the drawings in order to simplify the illustration.

Figure 7:
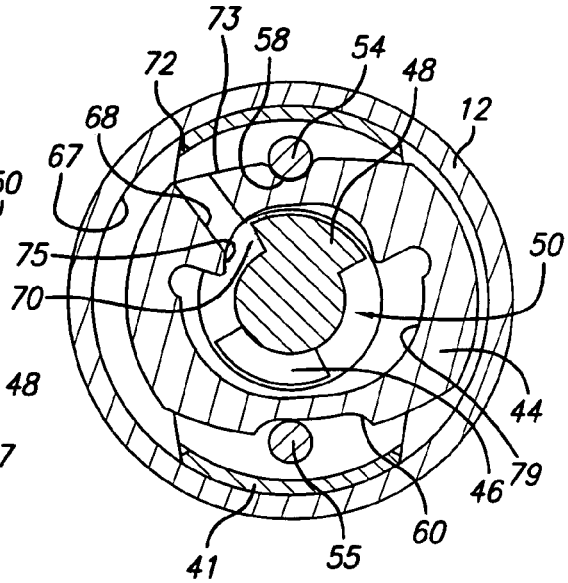
FIG. 7 is a view showing the lubricant being moved toward the center of the impact assembly.

Impact assembly 20 operates substantially as follows. As rotational energy is applied to frame 41, as shown in FIG. 4, frame 41 moves in either the counterclockwise or clockwise direction, thereby moving hammers 44, 46 simultaneously with frame 41. For example, when frame 41 is rotated counterclockwise (as viewed from the sectional view shown in FIGS. 4-7), hammer 44 rotates counterclockwise, and inwardly extending lip 66 of hammer 44 contacts wing 48, thereby causing anvil 50 to rotate with frame 41. Anvil 50 rotates with frame 41 as shown in FIG. 5 until resistance on anvil 50 originating from driver 16 surpasses a predetermined force. When resistance exceeds the predetermined force, hammer 44 pivots about pin 54 and lip 66 disengages from wing 48, as can be seen in FIG. 7. Once lip 66 is disengaged from wing 48, motor assembly 22 drives frame 41 and hammer 44 to rotate about anvil 50 until wing 48 again contacts lip 66, causing the impact associated with an impact tool.

It is desirable to have adequate lubrication in a tool such as that disclosed due to the rapidly moving parts and the engagement and disengagement of various components. Due to the centripetal force associated with the rotating motion of impact assembly 20 as described above, a lubricant generally is moved outwardly toward the walls 67 of chamber 14. In order to facilitate lubrication of inner components, the illustrative embodiment includes a lubrication hole or port 68 defining a passage formed in hammer 44 extending from an outboard portion 73 of the hammer 44 to an inboard portion 75 of the hammer 44. The passage 68 is one form of means for directing lubricant in the housing from a position generally outboard of the momentum means to a position generally proximate the hammering means. The port 68 operates to direct lubricant 70 from the walls 67 of chamber 14 radially inwardly toward the centrally located anvil 50.

Lubrication port 68 operates in substantially the following manner. As impact assembly 20 is rotated (illustratively counterclockwise), lubricant 70 collects or is captured along or in front of leading edge or scoop 72 of frame 41, as shown in FIG. 5. The lubricant 70 either comes from drippings from other components such as hammer 44, or it is gathered from the walls of chamber 14. During normal operation of impact tool 10, wing 48 will disengage from lip 66 as described above, and hammer 44 will resultingly pivot about pin 54 from the position shown in FIG. 5 to the position shown in FIG. 6. Such pivoting movement compresses the collected lubricant 70 shown in FIG. 5 and directs, channels or otherwise urges at least a portion of the collected or otherwise accumulated lubricant 70 into port 68 as shown in FIG. 6. Flow of lubricant through port 68 causes the lubricant to return to an interior or inner portion of the assembly proximate to the anvil 50. Repeated collection of lubricant and directing of lubricant into port 68 cause a generally radial inward flow of lubricant away from a generally radial outward position. Another action which would cause pivoting of hammer 44 is the reversal of direction of drive for motor assembly 22, thereby causing impact assembly 20 to rotate clockwise instead of counterclockwise. Such reversal would also urge collected lubricant 70 through port 68.

Lubricant 70 is urged through port 68 by both backpressure from additional lubricant and negative pressure resulting from wing 48 passing over port 68 drawing lubricant through the passage 68 into the operating bore 79 of the hammer 44. Once lubricant 70 passes radially inwardly through port 68, it is distributed to the central components with anvil 50 and wings 46, 48. It should be understood that while port 68 is shown on only one side of hammer 44, it is within the scope of the disclosure to manufacture hammer 44 such that a second port is on the opposite side of hammer 44, or so that the port is only formed on that side of the hammer 44. Similarly, hammer 42 can be configured to have one or more ports formed in it.

Figure 8:
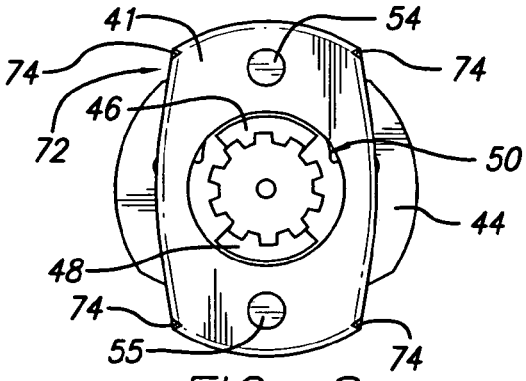
FIG. 8 is an elevation view of the impact assembly.

In one embodiment shown in FIG. 8, frame 41 includes guide grooves 74 which guide the collected lubricant 70 toward hammer 44. Guide grooves 74 are illustratively V-shaped grooves formed along a leading edge 72 of frame 41; however, other configurations for guide grooves 74 are within the scope of the disclosure. In use, the lubrication recirculation system for impacting mechanisms operates by utilizing the existing rocking or shifting movement of the hammers to accumulate and compress lubricants such as grease and direct it generally radially outward location to a generally radially inward location.

The impact mechanism or impact assembly 20 is modified in the present disclosure to recapture expelled lubricant and recirculate it among the components. The frame 41 is modified with the edge scoops 72, 74 that gather grease from the housing bore 14 wall 67. The hammer 42, 44 is modified with an appendage that compresses the grease, and a passage that allows the grease to travel to the generally internal lubrication site. The anvil 50 picks up the lubrication upon change in rotation direction. The modified impact mechanism helps to redistribute the lubrication without the need to disassemble the components of the tool, relubricate the components and then reassemble the tool. It is advantageous to employ this lubrication redistribution apparatus, system and method to reduce the need to use oil bath mechanisms as a lubrication system for tools. This is because the oil bath systems require oil seals to be employed in the tool which increases cost and reduces power output. Further, by recirculating the lubricant, the generally radially outwardly expelled lubricant is returned to the critical component thereby reducing the overheating and maintaining and improving the life and reliability of the tool. Further, by reducing overheating the tool is prevented from locking up as a result of thermal expansion. The lubrication recirculating and redistribution system of the present disclosure is applicable in any attitude of the tool. As the lubricant is expelled generally outwardly against the wall 67 of the tool it is recollected and redistributed inwardly. This works in attitudes in which the tool is down, upside down or any other orientation.

There are many advantages of the present disclosure arising from the various features of the lubrication system described herein. It will be noted that alternative embodiments of the lubrication system of the present disclosure may not include all of the features described yet still benefit from at least some of the advantages of such features. Those of ordinary skill in the art may readily devise other implementations of a lubrication system that incorporates one or more of the features of the present disclosure and falls within the spirit and scope of the present disclosure as defined by the following features and elements.

What is claimed is:

1. A lubrication system for a tool of the type having an impact assembly using a hammer, the lubrication system comprising: at least one passage in the hammer, the passage extending from an outboard portion of the hammer to an inboard portion of the hammer and located in the hammer so that hammer movement causes lubricant from the outboard portion to move toward the inboard portion.

2. The lubrication system as in claim 1, the lubrication system further comprising lubricant contained in the housing for lubricating at least the impact assembly.

3. A lubrication system for a tool of the type having an impact assembly using a hammer, the lubrication system comprising: at least one passage in the hammer, the passage extending from an outboard portion of the hammer to an inboard portion of the hammer for directing lubricant from the outboard portion to the inboard portion, the tool having a frame in which the hammer is operatively retained, the lubrication system further comprising a leading edge positioned on the frame formed for accumulating lubricant, the hammer being operable for positioning the passage in proximity for collecting the lubricant from the leading edge of the frame for directing the lubricant into the passage.

4. The lubrication system as in claim 3, further comprising the leading edge being shaped for promoting the accumulation of lubricant from a generally outboardly disposed internal portion of the tool and driving the lubricant into the passage.

5. The lubrication system as in claim 3, the tool having an anvil generally centrally disposed in an operating bore defined in the hammer, the lubrication system further comprising operation of the anvil in the operating bore creating a negative pressure drawing lubricant toward the anvil from an outboard position.

6. A tool comprising: a housing; an impact assembly operatively retained in the housing, the impact assembly having a drive assembly, a frame coupled to the drive assembly, at least one hammer operable in the frame and an anvil operatively associated with the hammer; and a lubrication system including at least one passage in the hammer, the passage extending from an outboard portion of the hammer to an inboard portion of the hammer and positioned for directing lubricant from the outboard portion to the inboard portion.

7. The tool as in claim 6, further comprising lubricant contained in the housing for lubricating at least the impact assembly.

8. The tool as in claim 6, the drive assembly further comprising a pneumatic drive device.

9. The tool as in claim 6, further comprising the anvil being generally centrally disposed in an operating bore defined in the hammer, operation of the anvil in the operating bore creating a negative pressure drawing lubricant toward the anvil from an outboard position.

10. A tool comprising: a housing; an impact assembly operatively retained in the housing, the impact assembly having a drive assembly, a frame coupled to the drive assembly, at least one hammer operable in the frame and an anvil operatively associated with the hammer; and a lubrication system including at least one passage in the hammer, the passage extending from an outboard portion of the hammer to an inboard portion of the hammer for directing lubricant from the outboard portion to the inboard portion, further comprising the frame having a leading edge positioned and formed for accumulating lubricant, the hammer being operable for positioning the passage in proximity for collecting the lubricant from the leading edge of the frame for directing the lubricant into the passage.

11. A tool comprising: a housing; an impact assembly operatively retained in the housing, the impact assembly having a drive assembly, a frame coupled to the drive assembly, at least one hammer operable in the frame and an anvil operatively associated with the hammer; and a lubrication system including at least one passage in the hammer, the passage extending from an outboard portion of the hammer to an inboard portion of the hammer for directing lubricant from the outboard portion to the inboard portion, further comprising the housing having an internal wall defining a bore therein, the impact assembly and lubrication system being retained in the bore; the frame being positioned in the bore proximate the wall for accumulating lubricant which is displaced generally radially outwardly toward the wall from a central area of the bore; and the outboard portion of the hammer being operatively positioned relative to the frame for positioning the passage in proximity to an accumulation of lubricant to drive the lubricant into the passage.

12. The tool as in claim 9, the frame further comprising a leading edge shaped for promoting the accumulation of lubricant from the wall of the housing and driving the lubricant into the passage.

13. A method for lubricating a tool; providing a tool housing; providing an impact assembly operatively retained in the housing; providing at least one hammer in the impact assembly; providing at least one passage in the hammer extending from an outboard portion of the hammer to an inboard portion of the hammer and located to direct lubricant in a radially inward direction; operating the impact assembly for operating the hammer and moving lubricant generally radially outwardly; and directing lubrication inwardly through the passage by operation of the hammer in the impact assembly.

14. The method of lubricating a tool as in claim 13, further comprising the steps of: providing an anvil in the impact assembly; providing an operating bore in the hammer; operatively positioning the anvil in the operating bore; operating the anvil in the operating bore; creating a negative pressure by operation of the anvil in the operating bore; and drawing lubricant inwardly toward the anvil through the passage by application of the negative pressure.

15. A method for lubricating a tool; providing a tool housing; providing an impact assembly operatively retained in the housing; providing at least one hammer in the impact assembly; providing at least one passage in the hammer extending from an outboard portion of the hammer to an inboard portion of the hammer; operating the impact assembly for operating the hammer; and directing lubrication inwardly through the passage by operation of the hammer in the impact assembly, further comprising the steps of: providing a frame in the impact assembly; providing a leading edge on the frame; accumulating lubricant along the leading edge; and positioning the passage in proximity to the leading edge for directing the lubricant into the passage.

16. In an impact tool of the type having a housing with an impact assembly operatively retained in the housing, the impact assembly having drive assembly, a frame coupled to the drive assembly, at least one hammer operable in the frame and an anvil operatively associated with the hammer; a lubrication system comprising: at least one passage in the hammer; the passage extending from an outboard portion of the hammer to an inboard portion of the hammer and positioned with respect to the frame and hammer so that lubricant from the outboard portion is directed to the inboard portion.

17. In an impact tool as in claim 16, further comprising lubricant contained in the housing for lubricating at least the impact assembly.

18. In an impact tool as in claim 16, the drive assembly further comprising a pneumatic drive device.

19. In an impact tool as in claim 16, the lubrication system further comprising the frame having a leading edge positioned and formed for accumulating lubricant, the hammer being operable for positioning the passage in proximity for collecting the lubricant from the leading edge of the frame for directing the lubricant into the passage.

20. In an impact tool as in claim 16, the lubrication system further comprising the anvil being generally centrally disposed in an operating bore defined in the hammer, operation of the anvil in the operating bore creating a negative pressure drawing lubricant toward the anvil from an outboard position.

21. In an impact tool of the type having a housing with an impact assembly operatively retained in the housing, the impact assembly having a drive assembly, a frame coupled to the drive assembly, at least one hammer operable in the frame and an anvil operatively associated with the hammer; a lubrication system comprising: at least one passage in the hammer; the passage extending from an outboard portion of the hammer to an inboard portion of the hammer for directing lubricant from the outboard portion to the inboard portion, further comprising the housing having an internal wall defining a bore therein, the impact assembly and lubrication system being retained in the bore; the frame being positioned in the bore proximate the wall for accumulating lubricant which is displaced generally radially outwardly toward the wall from a central area of the bore; and the outboard portion of the hammer being operatively positioned relative to the frame for positioning the passage in proximity to an accumulation of lubricant to drive the lubricant into the passage.

22. In an impact tool as in claim 21, the lubrication system further comprising the frame having a leading edge shaped for promoting the accumulation of lubricant from the wall of the housing and driving the lubricant into the passage.

23. A tool comprising: a housing; means for providing momentum retained in the housing; means for providing a hammering force retained in the housing; means for directing lubricant in the housing from a position generally outboard of the momentum means in an inward direction to a position generally proximate the hammering means.

24. The tool as in claim 23, the momentum means further comprising at least a drive assembly.

25. The tool as in claim 23, the hammering means further comprising at least an impact assembly.

26. The tool as in claim 25, the lubricant directing means further comprising at least a passage formed in at least a portion of the impact assembly.

* * * * *